United States Patent [19]

Favale

[11] 4,108,522

[45] Aug. 22, 1978

[54] JUMPER PLUG AND SOCKET

[75] Inventor: Anthony George Favale, Peabody, Mass.

[73] Assignee: Bell Telephone Laboratories, Incorporated, Murray Hill, N.J.

[21] Appl. No.: 800,079

[22] Filed: May 24, 1977

[51] Int. Cl.[2] ..... H01R 29/00; H01R 31/08

[52] U.S. Cl. ..... 339/19; 339/18 C; 339/91 R; 339/113 L

[58] Field of Search ..... 339/19, 18 R, 18 B, 339/18 C, 18 P, 91 R, 184 R, 184 M, 222, 198 N; 339/113 R, 113 L

[56] References Cited

FOREIGN PATENT DOCUMENTS

| | | | |
|---|---|---|---|
| 726,524 | 3/1932 | France | 339/19 |
| 599,656 | 7/1934 | Fed. Rep. of Germany | 339/18 R |
| 1,806,533 | 5/1970 | Fed. Rep. of Germany | 339/19 |
| 161,149 | 6/1905 | Fed. Rep. of Germany | 339/184 M |

*Primary Examiner*—Neil Abrams
*Attorney, Agent, or Firm*—Joseph A. Cameron

[57] ABSTRACT

A multiterminal socket suitable for mounting on a printed wiring board together with one or more jumper plugs is disclosed for providing various circuit options. The jumper plugs have a pair of interconnected male terminals projecting from one end and a pair of resilient extensions straddling the male terminals. When a plug is inserted in a correct socket position the plug extensions flex outwardly to pass over a pair of socket shoulders and lock the plug in place with a snap action. When an attempt is made to insert the plug in an incorrect position which would cross-connect circuits, a pair of opposing projections on the socket body interfere with the plug extensions to prevent insertion. Double throw switching functions and single throw functions with idle plug storage are described together with a visual indication of the option in effect.

9 Claims, 11 Drawing Figures

JUMPER PLUG AND SOCKET

BACKGROUND OF THE INVENTION

This invention relates to the field of electrical connectors and switches, particularly those intended for infrequent switching functions.

In the broad field of telecommunications there is frequently a need for switching functions which are very reliable but which may be exercised only a few times during the life of the equipment. In telephone repeaters, for example, the amount of gain and equalization applied by the repeater is a function of the length of line between repeaters, a very wide range of adjustment being needed. Continuously variable components are very expensive, and the stocking of several types of repeaters with different amounts of gain and equalization is very cumbersome. The option type switch, therefore, by means of which increments of impedance may be connected in or out of the circuit to vary gain and equalization has proved very useful.

One type option switch which has been used in large quantities is a screw block terminal in which a metal screw is turned into a plastic threaded nut until the head of the screw makes contact with two terminals partially imbedded in the plastic nut to interconnect the two terminals. One difficulty with this screw block terminal has been caused by the lack of a positive snap action feel to the switching operation. The craftsperson turning the screw to provide the jumper connection cannot easily tell when the connection has been made secure enough for the necessary long term reliability. The tendency is to tighten the screw too tight, stripping the threads in the plastic nut; the terminal is thereby destroyed, requiring replacement. An object of this invention, therefore, is a reliable option switch with snap action.

A second problem with the screw block terminal was the inability to visually determine which of the screws were tightened enough to make connections and which were not. A second object of this invention, therefore, is an option switch with a visual indication of the option chosen.

Another type switch frequently used to provide the option switch function is the slide switch. Existing slide switches, however, are relatively expensive and relatively large compared to the miniaturized circuits of recent design. A third object of this invention, therefore, is an inexpensive miniature option switch assembly.

An inexpensive arrangement for the option switch function is the combination of a socket housing many female terminals and one or more jumper plugs which can be inserted in various positions in the socket to interconnect combinations of terminals. This type arrangement, however, raises the possibility that the plug can be inserted in such a way as to cross-connect circuits. A fourth object of this invention, therefore, is a socket and jumper plug option switch arrangement in which cross-connections are prevented. Finally, in a multi-terminal socket-jumper plug arrangement, the number of plugs in use may differ according to the particular option chosen. It is, therefore, very useful to have on hand in each piece of equipment the total number of plugs that might be used. It is a fifth object of this invention to provide storage for idle jumper plugs.

SUMMARY OF THE INVENTION

In a jumper plug and socket combination, the insulating socket body has a row of holes for receiving female terminals, a pair of shoulders parallel to the row of holes increasing the width of the socket and pairs of opposing projections extending beyond the width of the shoulders and dividing the socket into sections. The jumper plug comprises an insulating plug body with a pair of interconnected male terminals projecting from one end thereof, and a pair of resilient plug body extensions straddling the male terminals. The extensions cooperate with the socket projections to prevent the plug from bridging holes between socket sections. They also cooperate with the socket shoulders to force the plug toward the socket when bridging holes within a socket section to provide snap action operation and positive locking. Sockets with three terminal holes to a section between projections allow double throw switch operation and plug storage for idle plugs in single throw sections. A raised surface on one half of a socket section allows coating with a contrasting color for visual verification of the switch option in operation.

DETAILED DESCRIPTION

Figure 1A:
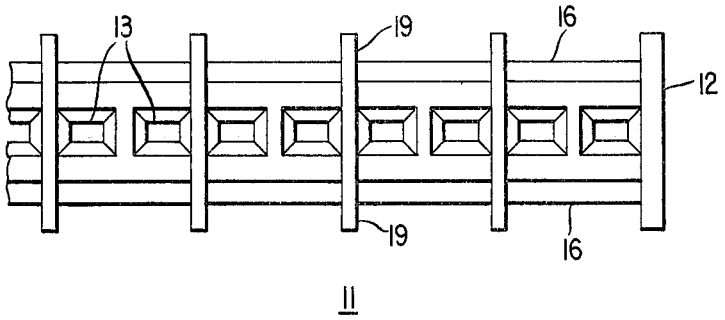
FIGS. 1A, 1B and 1C are plan, front and sectional views, respectively, of a socket of one embodiment of the invention.
Figure 1B:
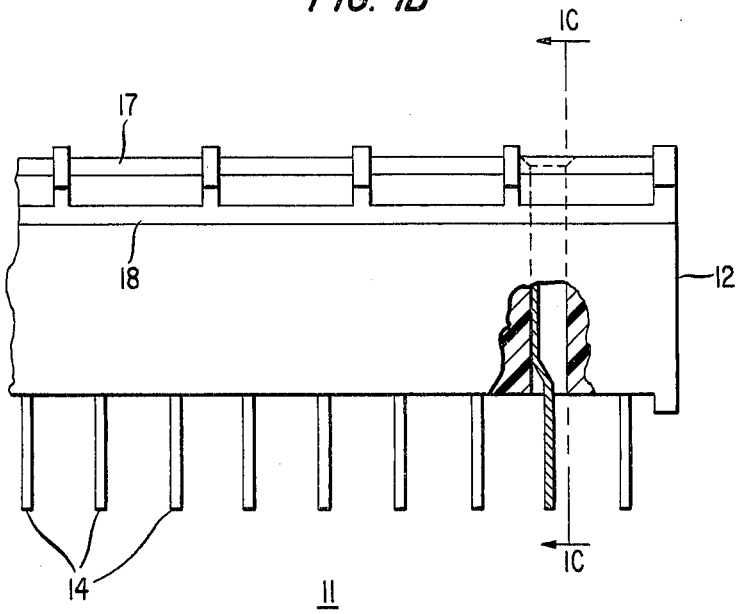
Figure 1C:
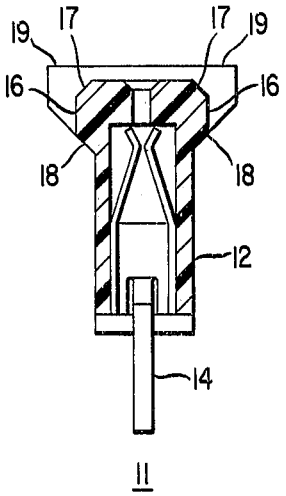

A socket which is inexpensive to manufacture and adapted for mounting on a printed wiring board, and which embodies the principles of the invention is shown in the three views of FIGS. 1A, 1B and 1C. Socket 11 comprises a molded plastic body 12 having a row of equally spaced holes 13 therein for receiving female terminals and female spring-type terminals 14 retained in the holes. According to standard socket practice, the top entry of the holes may be chamfered to facilitate insertion of male terminals. The top surface of socket body 12 has a pair of shoulders 16 which enlarge the width of the socket body. The top and bottom edges of the shoulders 16 are chamfered on surfaces 17 and 18 respectively. Pairs of opposing projections 19 extend beyond the edges of shoulder 16, dividing the socket into sections. The top edges of projections 19 may advantageously be flat and parallel with the top socket surface. Projections 19 may also be joined to form a ridge completely across socket body 12. Terminals 14, of course, may be retained in holes 13 by any of the methods well known in the connector art.

Figure 2A:
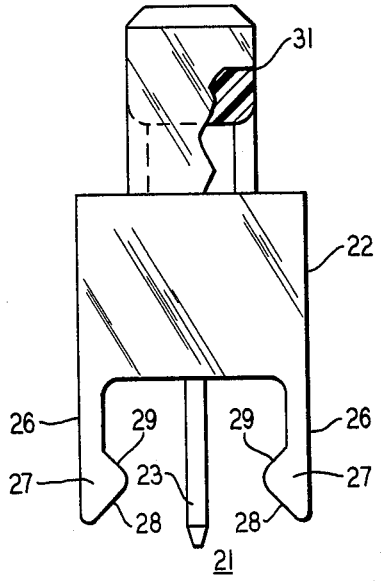
FIGS. 2A and 2B are partly sectional side and front views, respectively, of a jumper plug embodiment which forms part of the invention.
Figure 2B:
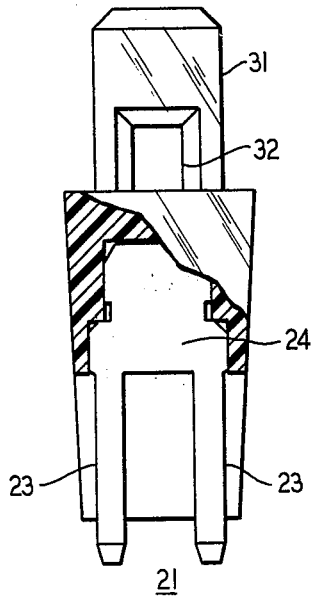

A jumper plug which cooperates with the socket 11 to form an embodiment of the invention is illustrated in the two views, FIG. 2A and FIG. 2B. Jumper plug 21 includes a plastic plug body 22 and a pair of interconnected male terminals 23 retained therein. Since terminals 23 are interconnected according to the invention to form a jumper plug, they may be stampled from a single metal piece to form a terminal assembly 24. Illustrated terminal assembly 24 is designed in a manner well known in the art to be pressfit into a recess in plug body 22 with just the terminal portions 23 projecting. In accordance with the invention, plug body 22 also has a pair of resilient extensions 26, one on each side of terminal assembly 24. Each extension 26 has an enlarged portion 27 extending inwardly near its outer extremity. The bottom surfaces of extensions 26 are formed into chisel points with an angle inclined toward the center of the plug and the upper surfaces of enlarged portions 27 are defined by an angle inclined toward the outside edges of the plug. For convenience in inserting and removing the plug, plug body 22 may also include a handle 31 with rectangular sides and smaller horizontal dimensions than the maximum plug dimensions for clearance to allow easy grasping by a pair of long nose pliers. In addition, handle 31 may include a hole 32 for the insertion of any hook-like tool to aid in removing the plug from the socket.

Figure 3C:
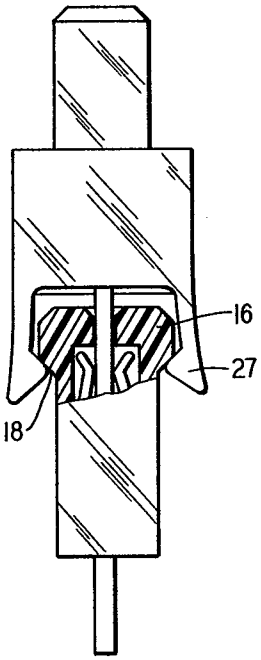
FIGS. 3A, 3B and 3C are assembly drawings illustrating the cooperation of the socket and plugs according to the invention.
Figure 3B:
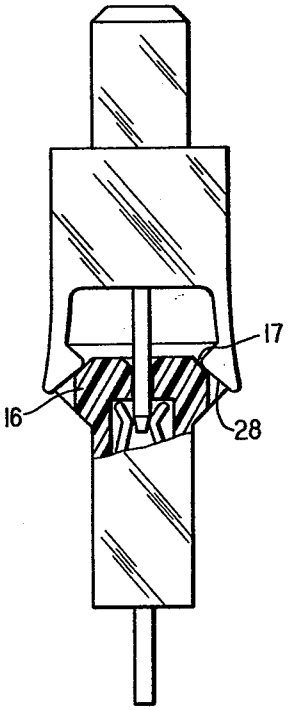
Figure 3A:
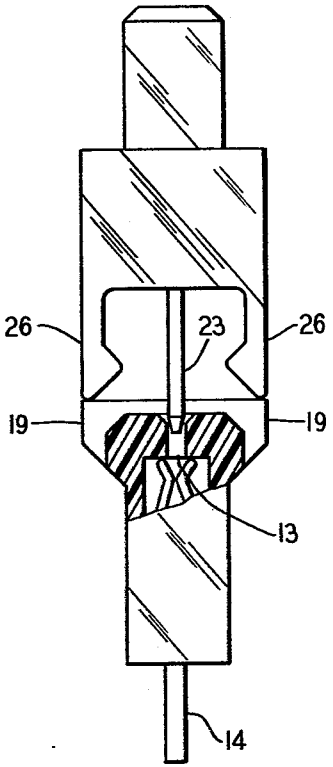

The assembly drawing of FIG. 3A illustrates the manner in which the plug and socket combination of the invention prevents cross-connections, that is, connections between socket sections. When an attempt is made to insert the plug with a male terminal on either side of a pair of projections 19, plug extensions 26 make contact with the flat upper surface of socket projections 19, and male terminals 23 are prevented from entering far enough into holes 13 to contact female terminals 14. When the jumper plug of the invention is inserted into adjacent holes within a section of the socket, however, angular surfaces 28 of plug extensions 26 bear against the upper chamfer surfaces 17 of the socket body 12, as shown in assembly drawing FIG. 3B. As force is applied to mate the plug into the socket, socket chamfers 17 apply a spreading force to plug extensions 26 causing them to deflect outwardly so that they will clear the outer edges of shoulders 16. Finally, as the insertion of the plug into the socket continues, the enlarged portions 27 of resilient extensions 26 pass beyond the socket shoulders 16. At this point the inward pressure applied by the deformed resilient extensions 26 to the angled bottom surface 18 of shoulders 16 results in a force pulling the plug into the socket with a snap action. Angles of approximately 45° to the vertical on both plug extension surfaces 28 and 29 and on both socket shoulder surfaces 17 and 18 provide excellent spreading and seating forces, but these angles are not critical.

The plug and socket combination described is simple and inexpensive to produce. The bodies may be molded out of any of a number of common plastics such as, for example, a polycarbonate or polyamide; the terminals can be retained therein by any of the various common methods such as press-fitting or the action of a spring tab latching against a shoulder in the socket hole. The sockets are well adapted for attachment to a printed wiring board. The terminal ends may be soldered into holes in the board, while the bottom surface of the socket rest firmly on the board. The plug and socket combination of my invention, therefore, is an inexpensive, very reliable option switch which locks together with snap action. The plug may be used to connect any adjacent terminals within a socket section but will not bridge socket sections to cross-connect circuits. Finally, the presence or absence of a plug in a socket section provides an evident visual indication of the option in effect for that section.

Figure 4A:
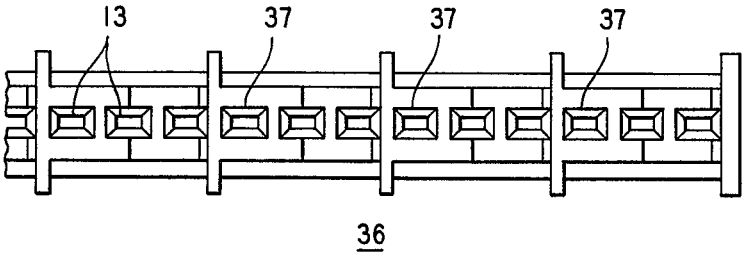
FIGS. 4A, 4B and 4C are plan, front and sectional side views, respectively, of a socket of another embodiment of the invention.
Figure 4B:
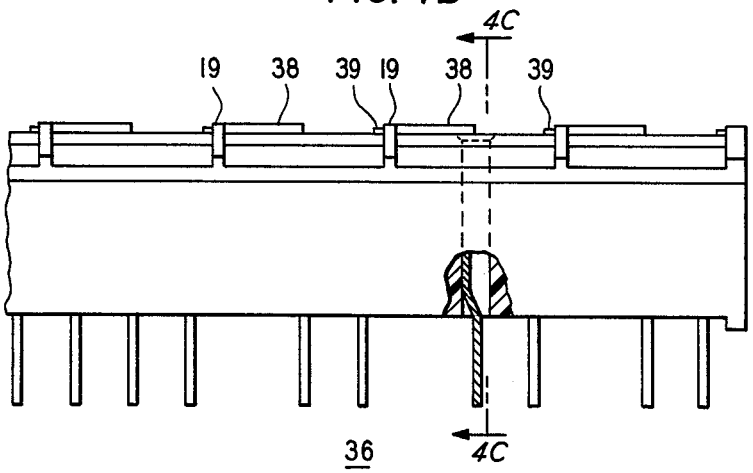
Figure 4C:
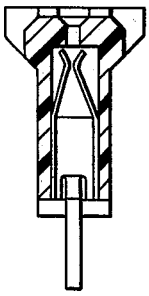

Socket 36, shown in FIGS. 4A, 4B and 4C, in combination with jumper plug 21 forms another very useful embodiment of my invention. This structure may be used as a single throw on/off switch, as was the combination with socket 11 previously described. Socket 36, although longer than socket 11, provides the additional features of plug storage for switch sections in the off position and double throw switching capability, and it, too, provides a visual indication of the switch option selected. In socket 36 there are three holes for receiving female terminals in each socket section, and a jumper plug may be inserted to connect the terminal in the center hole with that in either adjacent hole. This, of course, provides the equivalent of a single pole double throw switching function. Where only a single throw function is required, female socket terminal 14 may be left out of one of the holes as holes 37 of FIGS. 4A and 4B to minimize cost. Since the snap action plug seating and locking arrangement does not involve the terminals, but only the socket and plug bodies, the missing socket terminals in no way affect the retention of the plug; in fact, the plug may be stored indefinitely in its off position, that is, with one male terminal in the center hole of a section and the other male terminal in an empty hole, in case the other option ever has to be exercised. With this self-storing arrangement it is often helpful for a craftsperson to be able to glance at an option switch assembly and know immediately which switch option is in effect in each socket section. To aid in this rapid visual determination, one half the socket in each section may be painted with a contrasting color, for instance, the socket may be molded of black material and one half the socket in each position painted white. As shown in FIG. 4B, in the left half of each socket section, the top surface of the socket body has been slightly raised to be even with projections 19. This allows an easy roller application of paint or epoxy to the top surface of the socket to color the left half in a contrasting color. When the plug is in the left half or stored position, the white paint is covered by the plug and does not show. On the other hand, when the plug is in the right half of any section, the left half is empty and the white paint shows that the switch option is "on". Finally, in order to reduce the rocking action of a plug seated in the on position, a very small area 39 on the top of the socket immediately to the left of projections 19 may be raised slightly while remaining below the level where it would receive the rolled-on paint.

The plug and socket combinations of this embodiment, therefore, provide double throw switch functions, plug storage while in the off position of single throw functions and a visual indication as to which switch option is in operation.

What is claimed is:

1. In combination, a socket comprising an insulating body having a row of holes extending through said body from top to bottom for receiving terminals therein, a pair of shoulders extending along opposite sides of said socket body, parallel to said row of holes, increasing the width of said body in the area of said shoulders, and at least one pair of opposing projections extending beyond the width of said shoulders and dividing said row of holes into sections, and a plurality of first terminals retained in selected holes of said row of holes; and at least one jumper plug for selectively connecting adjacent first terminals comprising an insulating plug body, a pair of interconnected second terminals for mating with said first terminals, said second terminals retained in said plug body and projecting from one end thereof, and a pair of resilient extensions extending from said one body end straddling said second terminals, said extensions cooperating with said socket projections to prevent said plug from bridging holes between socket sections and with said shoulders to force said plug towards said socket when bridging holes within a section.

2. A combination as in claim 1, wherein said extensions each have an inwardly projecting portion requiring the outward flexing of said extensions to clear said socket shoulders.

3. A combination as in claim 2, wherein said socket holes are equally spaced and said second terminals extend beyond said plug extensions to engage said socket holes but not said first terminals before said extensions contact said socket.

4. A combination as in claim 2, wherein the surfaces of said inwardly projecting portions of said plug body extensions furthest from said plug body are inclined inwardly toward said plug body and the surfaces of said projecting portions nearest said plug body are inclined outwardly toward said plug body.

5. A combination as in claim 2, wherein the upper and lower surfaces of said socket shoulders are chamfered to apply spreading and seating forces, respectively, to said plug extensions.

6. A combination as in claim 2, wherein at least one of said socket sections has three holes defining two alternative positions for inserting said plug within said one socket section.

7. A combination as in claim 6, wherein the portion of the top surface of said socket section visible when said plug is in one of said alternative positions is colored in contrast to the portion of said top surface visible when said plug is in the other of said alternative positions.

8. A combination as in claim 7, wherein approximately one half said top surface, including the said portion visible when the plug is in said one alternative position, is raised above the remainder of said top surface.

9. Apparatus for performing a switching function comprising a socket having an insulating body, said socket body having a row of three holes therethrough, a pair of shoulders extending along opposite sides of said socket body parallel to said row of holes, increasing the width of said body in the area of said shoulders, and two pairs of opposing projections extending beyond the width of said shoulders, each pair of said projections being located at a respective end of said row of holes, and at least two first terminals retained in the center hole and one end hole, respectively, of said row of holes; and a jumper plug for selectively bridging said first terminals having an insulating plug body, a pair of interconnected second terminals for mating with said first terminals, said second terminals retained in said plug body and projecting from one end thereof, and a pair of resilient extensions extending from said one plug body end and straddling said second terminals; said extensions cooperating with said socket projections to prevent said second terminals from occupying only one of said three holes, and with said shoulders to clamp said plug to said socket with said second terminals occupying said center hole and either end hole respectively.

* * * * *